US010631570B1

(12) United States Patent
Morris

(10) Patent No.: US 10,631,570 B1
(45) Date of Patent: Apr. 28, 2020

(54) TOOL TRAY AND ITS APPLICATION SYSTEM AND METHOD OF APPLYING CONCENTRATE

(71) Applicant: Robert Elliott Morris, Ashland, OR (US)

(72) Inventor: Robert Elliott Morris, Ashland, OR (US)

( * ) Notice: Subject to any disclaimer, the term of this patent is extended or adjusted under 35 U.S.C. 154(b) by 0 days.

(21) Appl. No.: 15/831,798

(22) Filed: Dec. 5, 2017

Related U.S. Application Data

(60) Provisional application No. 62/570,489, filed on Oct. 10, 2017.

(51) Int. Cl.

| | |
|---|---|
| ***A24F 21/00*** | (2006.01) |
| ***B65D 25/10*** | (2006.01) |
| ***A24F 19/10*** | (2006.01) |
| *A24F 47/00* | (2020.01) |

(52) U.S. Cl.
CPC ..... *A24F 21/00* (2013.01); *B65D 25/107* (2013.01); *A24F 19/10* (2013.01); *A24F 47/002* (2013.01)

(58) Field of Classification Search
CPC ..... A24F 21/00; A24F 19/10; A24F 19/105; A24F 23/04; A24F 47/002; A24F 15/08; B65D 25/107
USPC ..... 206/242, 246, 86, 236, 459.1, 459.5, 206/560–562, 564, 565, 349, 361; 131/242
See application file for complete search history.

(56) References Cited

U.S. PATENT DOCUMENTS

| | | | | |
|---|---|---|---|---|
| 376,001 | A | 1/1888 | Johnson | |
| 2,786,595 | A * | 3/1957 | Nelson | A24F 19/00 220/212 |
| 3,397,829 | A * | 8/1968 | Wilkins | B65D 11/1873 229/4.5 |
| 4,187,864 | A | 2/1980 | Taddeo | |
| 5,423,335 | A * | 6/1995 | Evans | A24F 9/14 131/232 |
| 5,706,831 | A | 1/1998 | Whitbeck | |
| 5,842,481 | A | 12/1998 | King | |
| 6,050,268 | A | 4/2000 | San Filippo | |
| 6,860,229 | B1 * | 3/2005 | Craft | A01K 5/0142 119/61.5 |
| D726,955 | S | 4/2015 | Martin | |
| D744,159 | S | 11/2015 | Lukas | |
| D790,127 | S | 6/2017 | Verleur | |
| 2013/0039639 | A1 * | 2/2013 | Carney | A61L 9/03 392/386 |
| 2014/0090226 | A1 * | 4/2014 | Langan | A61M 5/1417 29/428 |
| 2015/0064633 | A1 | 3/2015 | Dominguez et al. | |

* cited by examiner

*Primary Examiner* — Rafael A Ortiz
(74) *Attorney, Agent, or Firm* — Jerry Haynes Law

(57) ABSTRACT

A tool tray, its application system, and method of applying concentrate provides a tool holding container and a dab stick configured to apply a concentrate, such as cannabis concentrate, to a heated medium. The tool holding container stores the concentrate. The tool holding container includes a base end for resting on a surface, an annular end having a notch, a sidewall joining the ends, forming a cavity. A dab stick is detachably insertable in the notch to elevate the dab stick above the surface, and prevent the dab stick from rolling off the rim of tool holding container. The dab stick may also access concentrate from the cavity for application to a heated medium.

7 Claims, 5 Drawing Sheets

TOOL TRAY AND ITS APPLICATION SYSTEM AND METHOD OF APPLYING CONCENTRATE

CROSS-REFERENCE TO RELATED APPLICATIONS

This application claims priority from U.S. Provisional Application Ser. No. 62/570,489, entitled "Tool Tray and Application System and Method of Applying Concentrate", filed on Oct. 10, 2017, which application is hereby incorporated herein by reference in its entirety.

FIELD OF THE INVENTION

The present invention relates generally to a tool tray and application system and method of applying concentrate. More so, the present invention relates to a tool tray comprising a tool holding container to store concentrate and hold a tool such as a dab stick used for applying the concentrate to a heated medium.

BACKGROUND OF THE INVENTION

Ash trays, pen holders, and other tool trays for holding cylindrical tools such as pens, pencils, cigarettes, cigars, etc. are known in the art. These trays and holders and the like prevent the cylindrical tools from rolling around when not in use. Generally trays and holders may comprise a concave surface to rest the tool in a position.

Tool trays such as ash trays are generally used in cigar or cigarette smoking for collecting ash and to hold the cigar or cigarette in a position when not in use. Vaporization is an alternative to burning plant materials so as to avoid inhalation of irritating, toxic, and carcinogenic by-products occurring during inhalation of smoke from burning plant materials. Thus in concentrate vaporization systems, the tray comprises a conventional tray having one or more pot to hold concentrate inside the pot, but it does not provide any arrangement to position the dab stick in an elevated position while preventing the dab stick from rolling around when not in use and thus preventing from getting contaminated.

Numerous innovations have been provided in prior art that are adapted to tool holding containers for holding cylindrical tools. Even though these innovations may be suitable for the specific purposes to which they address, however, they would not be as suitable for the purposes of the present invention.

For example, U.S. Pat. No. 376,001 to Johnson discloses an ink bottle having a cap, wherein the cap comprises a means for holding a pen to prevent it from rolling around when not in use, and the cap facilitates pouring of ink from the bottle, and to afford means for securing the stopper and corkscrew in place when the bottle is to be shipped.

U.S. Pat. No. 4,187,864 to Taddeo describes a cigarette holder for ash receptacles that utilizes a cap adapted for attachment to the top of an opened beverage container. A groove is provided for resting cigarettes thereupon.

U.S. Pat. No. 5,706,831 to Whitbeck teaches a golf tool including a ball mark repair tool for repairing ball marks in turf, further a cigar support is coupled to the ball mark repair tool for supporting a cigar such that neither end of the cigar is in contact with the turf.

U.S. Pat. No. 5,842,481 to King discloses a V-shaped tray for holding a lit tobacco product such as a cigar. The tray is attached to an adjustable stem, wherein the stem is fastened to a spring-loaded utility clamp thereby protecting the cigars and the wide range of smoking accessories clamped to golf cart or a bag or the like.

U.S. Pat. No. 6,050,268 to San Filippo describes a pliable dual clamping cigar/cigarette holder having two spring clamping members for holding the cigar and simultaneously being temporarily clamped onto an object to hold the holder in a desired position.

U.S. Pat. No. D726,955 to Martin illustrates an ornamental design for an electronic cigarette holder.

U.S. Pat. No. D744,159 to Lukas illustrates an ornamental design for an electronic cigarette stand.

U.S. Pat. No. D790,127 to Verleur illustrates an ornamental design for a holder for vaporizers.

U.S. Pat. Application No. 2015/0064633 to Dominguez et al. describes a multi-tool lighter comprising tools commonly used in smoking hand rolled cigarettes, pipes, and medicinal marijuana. The tools housed in the lighter may include a poke tool and/or a tweezers and dab combination tool. The lighter housing acts as a handle for the tools to swing out from the lighter housing into an open position.

It is apparent now that numerous innovations for holding cylindrical tools such as pens, pencils, cigarettes, cigars, etc. in a position have been developed that are adequate for various purposes. Furthermore, even though these innovations may be suitable for the specific purposes to which they address, accordingly, they would not be suitable for the purposes of the present invention as heretofore described. Thus a tool tray for holding a tool used for applying concentrate, such as cannabis concentrate, to a heated medium, while also providing the optional functionality of storing the concentrate prior to application to the heated medium is needed.

SUMMARY OF THE INVENTION

The present invention discloses a tool tray, its application system, and method of applying concentrate which provides a tool holding container and a dab stick configured to apply a concentrate, such as cannabis concentrate, to a heated medium. The tool holding container stores optionally stores concentrate. The tool holding container includes a base end for resting on a surface, an annular end having a notch, a sidewall joining the ends, forming a cavity. A dab stick is detachably insertable in the notch to elevate the dab stick above the surface, and prevent the dab stick from rolling off the rim of tool holding container. The dab stick may also access concentrate from the cavity for application to a heated medium.

According to one aspect of the present invention a tool tray, wherein the tool tray includes at least one tool holding container, wherein the at least one container comprises a closed base end for resting on a surface, an annular open end defined by a notch, wherein perimeter of the base end being larger than perimeter of the annular end and a sidewall joining the base end with the annular end to form the tool holding container having an inner cavity to store concentrate, whereby the tool holding container is frustum shaped; and an elongated dab stick defined by a handle end and an application end, wherein the handle end allows for gripping and manipulating the dab stick and the application end allows for applying the concentrate to a heated medium, whereby the application end at least partially detachably inserts in the notch of the annular end of the tool holding container, thereby allowing the application end of the dab stick to rest in an inclined elevated position above the surface when the dab stick is not in use.

According to another aspect of the present invention a method for applying a cannabis concentrate is provided. The method includes setting a tool holding container on a surface, the tool holding container having a base end for resting on the surface, an annular end defined by a notch, and a sidewall joining the ends and forming a cavity; placing the cannabis concentrate in the cavity of the tool holding container; resting a dab stick in the notch of the annular end, the dab stick defined by a handle end for gripping and manipulating the dab stick, and an application end that is partially insert in the notch of the annular end of the tool holding container, thereby allowing the application end of the dab stick to rest in an inclined elevated position above the annular end of the tool holding container when the dab stick is not in use; dabbing a portion of the cannabis concentrate contained in the cavity with the application end of the dab stick; and applying the dabbed cannabis concentrate to a heated medium.

In view of the foregoing, it is therefore an objective of the present invention to provide an elevated dab stick for dabbing a sticky concentrate without having to place the concentrate on a surface.

Another objective is to lean the dab stick on the annular end or in the notch of the tool holding container to elevate the application end of the dab stick above the surface.

Another objective is to facilitate the process of simultaneously heating the medium, accessing the concentrate, and applying the concentrate.

Yet another objective is to avoid setting the concentrate down on a flat surface, such as a silicon mat, that can smear the concentrate.

Yet another objective is to provide a notch that prevents the dab stick from rolling off the annular end of the tool holding container because of the weight of the concentrate on the application end of the dab stick.

Yet another objective is to help identify a specific cannabis concentrate type by configuring the tool holding container or dab stick with a color or pattern, and thereby indicating the type of concentrate.

Yet another objective is to provide an aesthetic concentrate storage and application tool tray.

Other objectives and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 4:
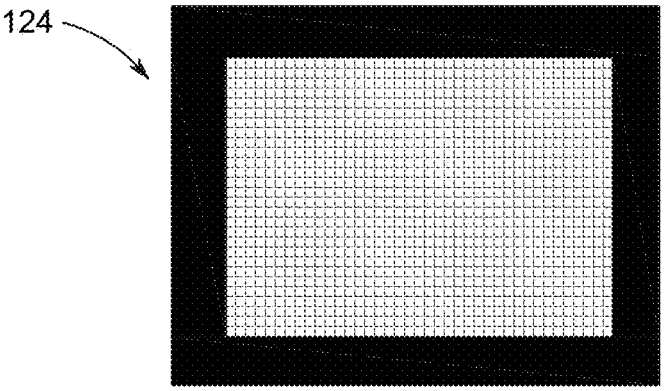
FIG. 4 illustrates a perspective view of an exemplary flat surface known in the art, in accordance with an embodiment of the present invention.
Figure 5:
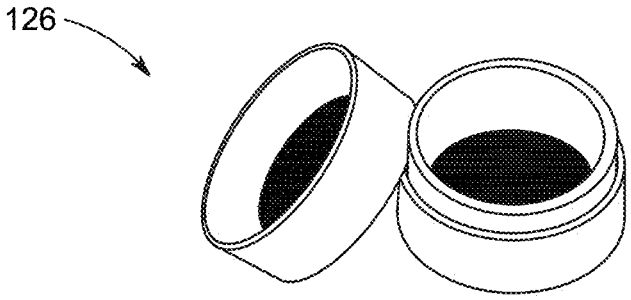
FIG. 5 illustrates a perspective view of an exemplary concentrate tool holding container known in the art, in accordance with an embodiment of the present invention.
Figure 7:
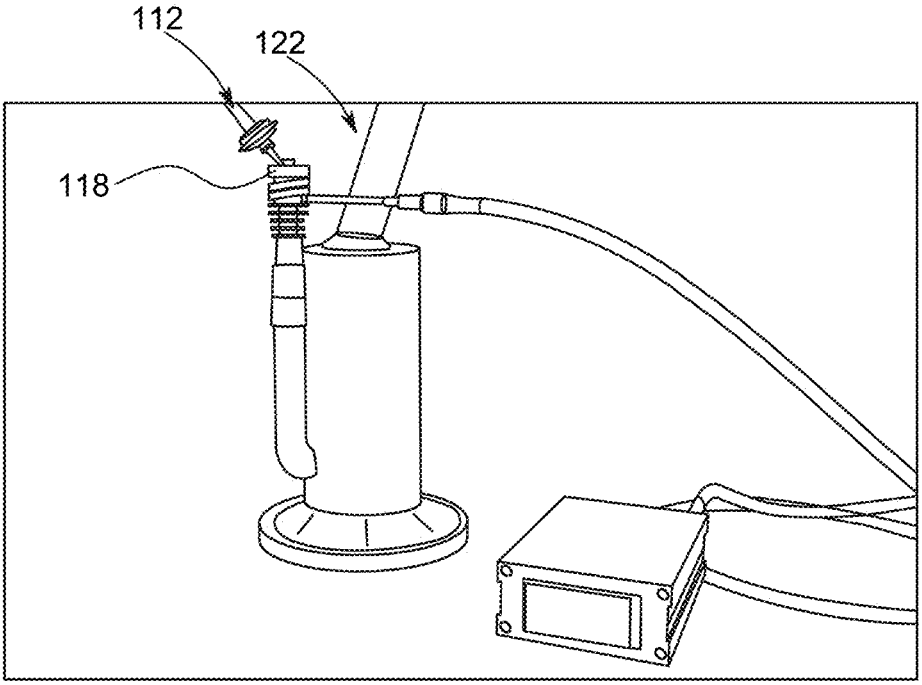
FIG. 7 illustrates a perspective view of the concentrate shown in FIG. 3 being smoked in a water pipe, in accordance with an embodiment of the present invention.

Vaporizers are commonly used to inhale cannabis for therapeutic purposes, such as reduction of chronic pain resulting from multiple sclerosis, epilepsy, HIV/AIDS, and other chronic ailments and diseases. Some studies have indicated that smoking cannabis *sativa* may substantially reduce daily pain in patients. Other studies have shown that vaporizing cannabis exposes the user to lower levels of harmful substances than inhaling smoke from burning cannabis. Further, extracted vapor may be inhaled directly through a hose or a pipe. Because vaporization produces substantially less smoke and cooler temperatures than does burning plant materials, smaller quantities of plant material is required to achieve a given level of effect, as compared with smoking plant materials. Thus, vaporization gives rise to a reduction of irritation and harmful effects commonly associated with smoking plant materials, as well as a reduction of second hand smoke. Generally for smoking vapors a tool tray containing one or more tool holding containers (FIG. 5), one or more dab sticks, one or more mat surface (FIG. 4) and concentrates are used as a kit along with a vaporizer (FIG. 7).

According to an embodiment of the present invention, a tool tray and its application system 100 and method 200 of applying concentrate are referenced in FIGS. 1-8. The tool tray and its application system 100, hereafter "tool tray 100" is configured to hold a tool 112 used for applying a concentrate 120 to a heated medium, while also providing the optional functionality of storing the concentrate 120 prior to application to the heated medium 118. The concentrate 120 may include a cannabis concentrate. Though other concentrates may also be used.

In another embodiment, tool tray 100 provides at least one tool holding container 102 configured to securely retain and elevate a dab stick 112 used for applying the concentrate 120 to a heated medium 118. The dab stick 112 is sized and dimensioned to facilitate holding the concentrate in an elevated, stable position and applying the concentrate 120 to a heated medium 118 to enable burning and consumption of the concentrate 120.

Figure 1:
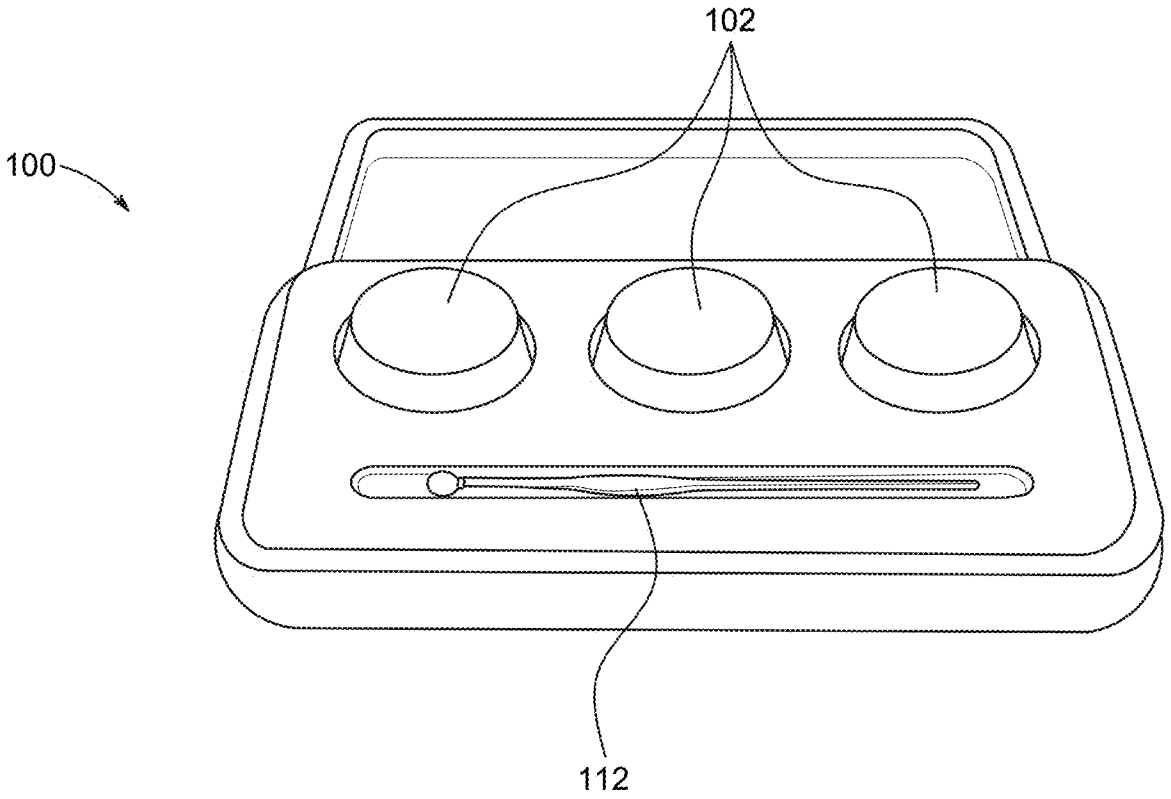
FIG. 1 illustrates a perspective view of an exemplary tool tray and its application system, in accordance with an embodiment of the present invention.

As referenced in FIG. 1 the tool tray 100 comprises one or more tool holding containers 102, at least one dab stick 112 contained in the tray 100.

Figure 2A:
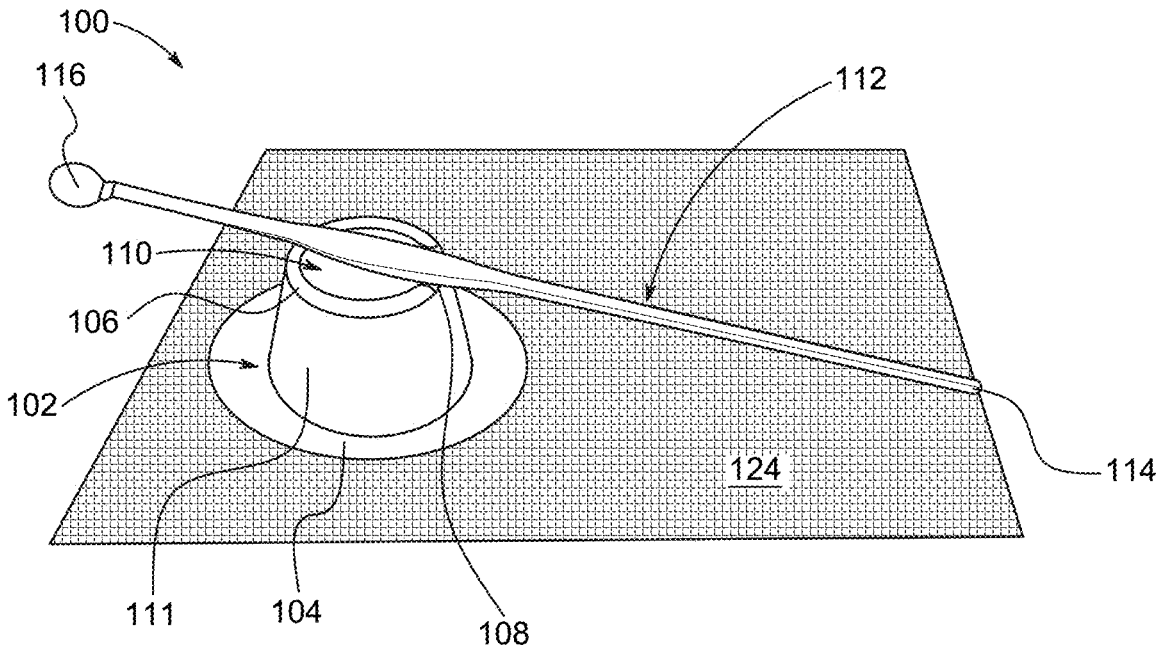
FIG. 2A illustrates a perspective view of an exemplary tool holding container with a dab stick held in an inclined and elevated position, in accordance with an embodiment of the present invention.

As referenced in FIG. 2A, the tool holding container 102 comprises a base end 104 for resting on a surface such as on ground or on a mat surface 124, an annular end 106 defined by a notch 108, a sidewall 111 joining the ends 104, 106. The sidewall 111 forms a cavity 110 for containing the concentrate 120. The tool tray 100 further comprises a dab stick 112 detachably insertable in the notch 108 that forms in the tool holding container 102. By inserting dab stick 112 in the notch 108, it is elevated above the ground surface and prevented from rolling off the tool holding container 102.

The dab stick 112 is adapted to access concentrate 120 from the cavity 110 in the tool holding container 102 for application to the heated medium 118. The dab stick 112 is defined by a handle end 114 for gripping and manipulating the dab stick 112. The dab stick 112 is also defined by an application end 116 that is elevated above a surface 124 for applying the concentrate 120 to the heated medium 118.

According to an exemplary embodiment of the present invention, a tool holding container 102 is provided, wherein the tool holding container 102 includes a base end 104, wherein the base end 104 is flat for resting on a surface; an annular end 106, wherein the annular end 106 comprises a means for holding a tool such as a dab stick 112, wherein the means for holding comprises a notch 108; and a sidewall 111, wherein a perimeter of the base end 104 being larger than a perimeter of the annular end 106 and the sidewall 111 joins the base end 104 with the annular end 106 to form the tool holding container 102 having an inner cavity 110.

According to another exemplary embodiment of the present invention, a tool tray and its application system 100, includes at least one tool holding container 102, wherein the at least one container 102 comprises a closed base end 104 for resting on a surface 124, an annular open end 106 defined by a notch 108, wherein perimeter of the base end 104 being larger than perimeter of the annular end 106 and a sidewall 111 joining the ends 104, 106 and to form the tool holding container 102 having an inner a cavity 110 to store concentrate, whereby the tool holding container is frustum shaped; and an elongated dab stick 112 defined by a handle end 114 and an application end 116, wherein the handle end 114 allows for gripping and manipulating the dab stick 112, and the application end 116 allows for applying the concentrate 120 to a heated medium 118, whereby the application end 116 at least partially detachably inserts in the notch 108 of the annular end 106 of the tool holding container 102, thereby allowing the application end 116 of the dab stick 112 to rest in an inclined elevated position above the surface 124 when the dab stick 112 is not in use.

In another aspect, the concentrate 120 is a medical cannabis concentrate or a recreational cannabis concentrate.

In another aspect, the tool holding container 102 has a frustum shape.

In another aspect, the dab stick 112 is elongated, thin, and cylindrical.

In another aspect, the dab stick 112 is fabricated from at least one of the following: titanium, quartz, and ceramic.

In another aspect, the heated medium 118 is a nail for a water pipe 122 or an e-nail, or a smoke pipe.

In another aspect, the tool holding container 102 contains the concentrate 120.

In another aspect, the notch 108 of the annular end 106 of the tool holding container 102 has a U-shape.

In another aspect, the perimeter of the base end 104 is double the perimeter of the annular end 106 of the tool holding container 102, thereby increasing stability of the base 104 while the container 102 is resting on the surface.

In another aspect, the notch 108 of the annular end 106 of the tool holding container 102 is configured to at least partially detachably insert a dab stick 112, thereby allowing the dab stick 112 to be held in an inclined elevated position in the notch 108 when the dab stick 112 is not in use.

In another aspect, the one or more tool holding containers 102 are indicated with different colors or patterns, thereby indicating the type of concentrate contained in the containers 102.

In another aspect, the at least one tool holding container 102 further comprises a cap.

Figure 3:
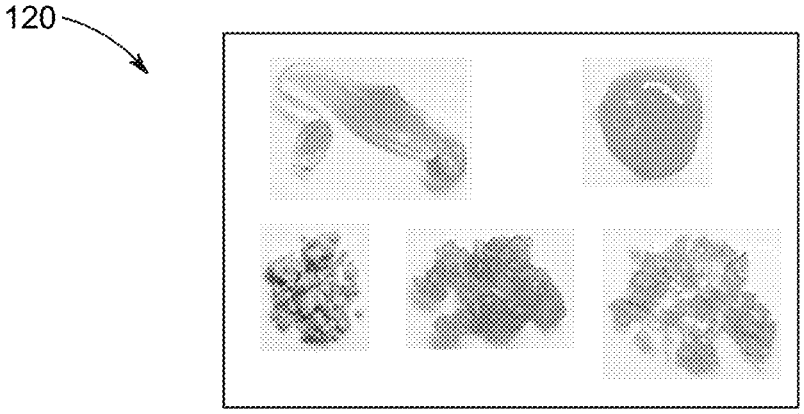
FIG. 3 illustrates a perspective view of different types of exemplary cannabis concentrates, in accordance with an embodiment of the present invention.

As shown in FIG. 3 several types of cannabis concentrate 120 varieties in different forms such as oil, shatter, or wax forms are used in vaporizers. Those skilled in the art will recognize that cannabis concentrate is obtained through an extraction process. In one exemplary method, cannabis concentrate 120 is made by placing cannabis into a long tube or pipe then adding butane, otherwise known as lighter fluid. The butane extracts THC into a hardened, very potent glob (or dab) that looks like ear wax. After the cannabis concentrate is cool, a dab is packed into a water pipe, vaporizer, or bong and smoked. Different types of cannabis concentrate 120 include, without limitation, kief, cannabis wax, water hash, CO2 oil, butane hash oil, rosin, and shatter. The type of cannabis can be medical grade cannabis, or cannabis smoked for recreational purposes.

Unfortunately, when attempting to obtain a portion of the cannabis concentrate with a stick or any such object, it is often necessary to heat the heating medium 118 at the same time. This is because the concentrate must receive optimal heat for smoking purposes. Both accessing the concentrate, heating the medium, and applying the concentrate on the heated medium 118 is a busty, cumbersome process that may require the cannabis concentrate 120 to be set down on a flat surface 124 (FIG. 4), or a standard concentrate tool holding container 126 (FIG. 5) while heating the medium 118. This may cause the cannabis concentrate 120 to smear, and also cause a portion of the concentrate 120 to be lost or contaminated on the surface 124 or edge of the standard concentrate tool holding container 126. Another problem with storing and applying concentrate 120 is that the type of concentrate 120 is not always apparent from its color and texture.

The present disclosure helps solve this problem by providing a tool holding container 102 and a dab stick 112 that is held in an elevated position by the tool holding container 102. The dab stick 112 is configured to apply the concentrate 120 to a heated medium 118, without having to set the concentrate 120 down on the flat surface 124 or on the edge of the standard concentrate tool holding container 126. Thus, the tool holding container 102 may be used to store the concentrate 120 and also supports the dab stick 112 in an elevated, stable position in a notch 108. The tool holding container 102 and the dab stick 112 may be colored or patterned to indicate a specific concentrate type.

Figure 2B:
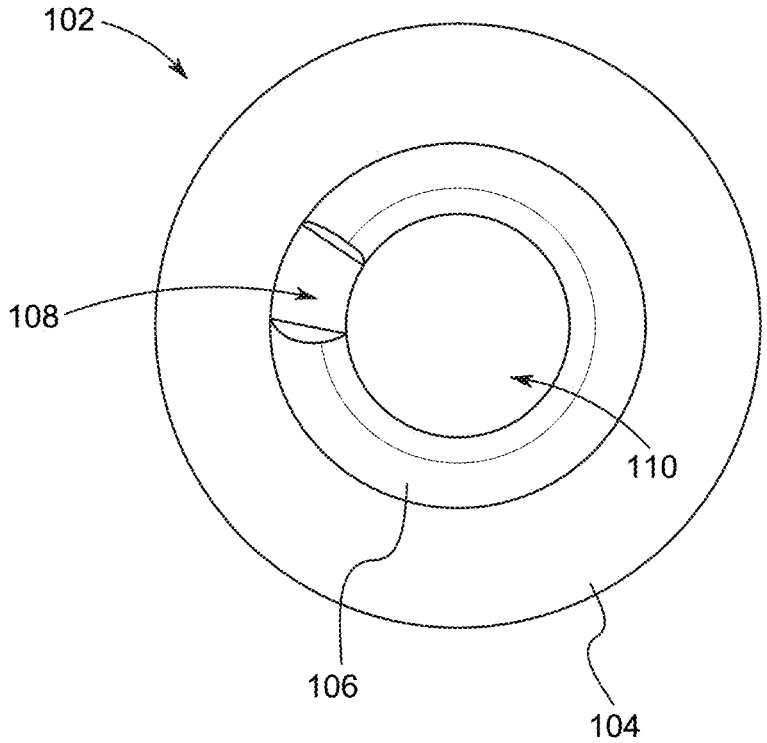
FIG. 2B illustrates a top view of an exemplary tool holding container having a notch to support a dab stick, in accordance with an embodiment of the present invention.

FIG. 2B references the tool tray 100. The tool tray 100 comprises a tool holding container 102 having a base end 104 for resting on a surface, an annular end 106 defined by a notch 108, and a sidewall 111 joining the ends and forming a cavity 110. In some embodiments; the cavity 110 may be used to store the concentrate 120. The tool holding container 102 may have a generally frustum shape with the annular end 106 being smaller than the base end 104.

As illustrated in FIGS. 2A and 2B, the notch 108, which forms at the rim of the annular end 106, is configured to retain the dab stick 112 in an elevated position, while also not allowing the dab stick to roll off the annular end 106 of the tool holding container 102 due to the weight of the concentrate 102. In one alternative embodiment, multiple notches may from at the rim of the annular end 106 of the tool holding container 102 to hold one or more dab sticks 112 in a stable position.

Thus, the primary purpose of the tool holding container 102 is to elevate the dab stick 112, and especially the application end 116 of the dab stick 112, above the surface. In this manner, the concentrate 120 does not have to be set down on a flat surface 124, which smears the cannabis concentrate 120, and causes a portion of the concentrate 120 to be lost or contaminated. The tool holding container 102 may have colors, patterns, and textures to enhance aesthetics or identify a specific type of cannabis concentrate 120. In some embodiments however, the tool holding container 102 may also be used to store concentrate until application by the dab stick 112.

Figure 6:
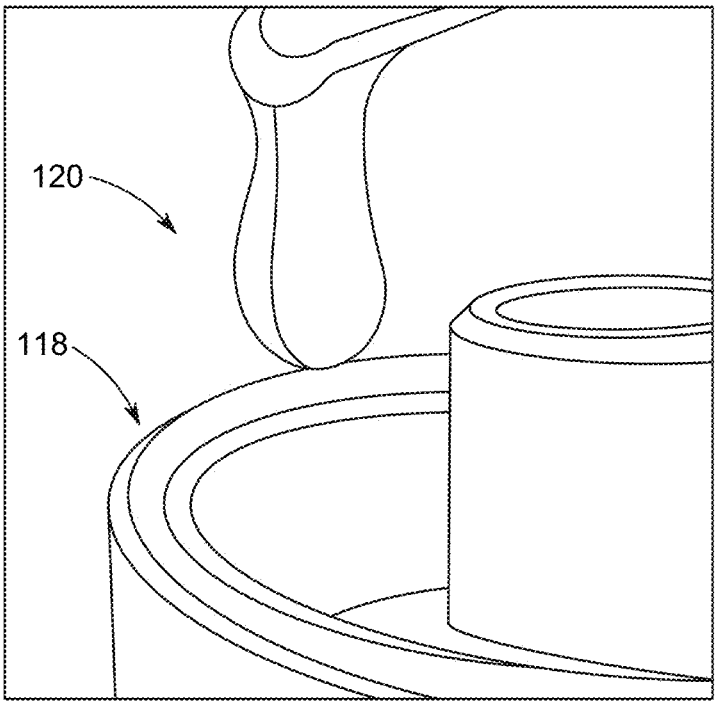
FIG. 6 illustrates a perspective view of the concentrates shown in FIG. 3 being applied to a heated medium, in accordance with an embodiment of the present invention.

In some embodiments, the tool tray 100 comprises a dab stick 112 defined by a handle end 114 and an application end 116. The handle end 114 is configured for gripping and manipulating the dab stick 112. The application end 116 is configured for applying the concentrate 120 to a heated medium 118, such as shown in FIG. 6. The application end 116 rests in the notch 108 of the tool holding container 102, so as to elevate above the surface and inhibit rolling off the annular end of the tool holding container 102. In this manner, the application end 116 and the concentrate 120 thereon are not resting on the surface 124 before applying the concentrate 120 to a heated medium 118.

In some embodiments, the dab stick 112 may be configured to be elongated, cylindrical, and thin. This provides an aesthetic stick that is easily manipulated by the hand and suitable for dabbing concentrate 120 from the cavity 110 of the tool holding container 102 and applying to the heated medium 118, such as a nail from a water pipe 122.

Suitable materials for the dab stick 112 may include, without limitation, titanium, quartz, and ceramic. As FIG. 7 illustrates, after an appropriate amount of cannabis concentrate 120 is applied to the heated medium 118, i.e. nail, the cannabis concentrate 120 may be smoked through a water pipe 122 or other smoking device known in the art.

Figure 8:
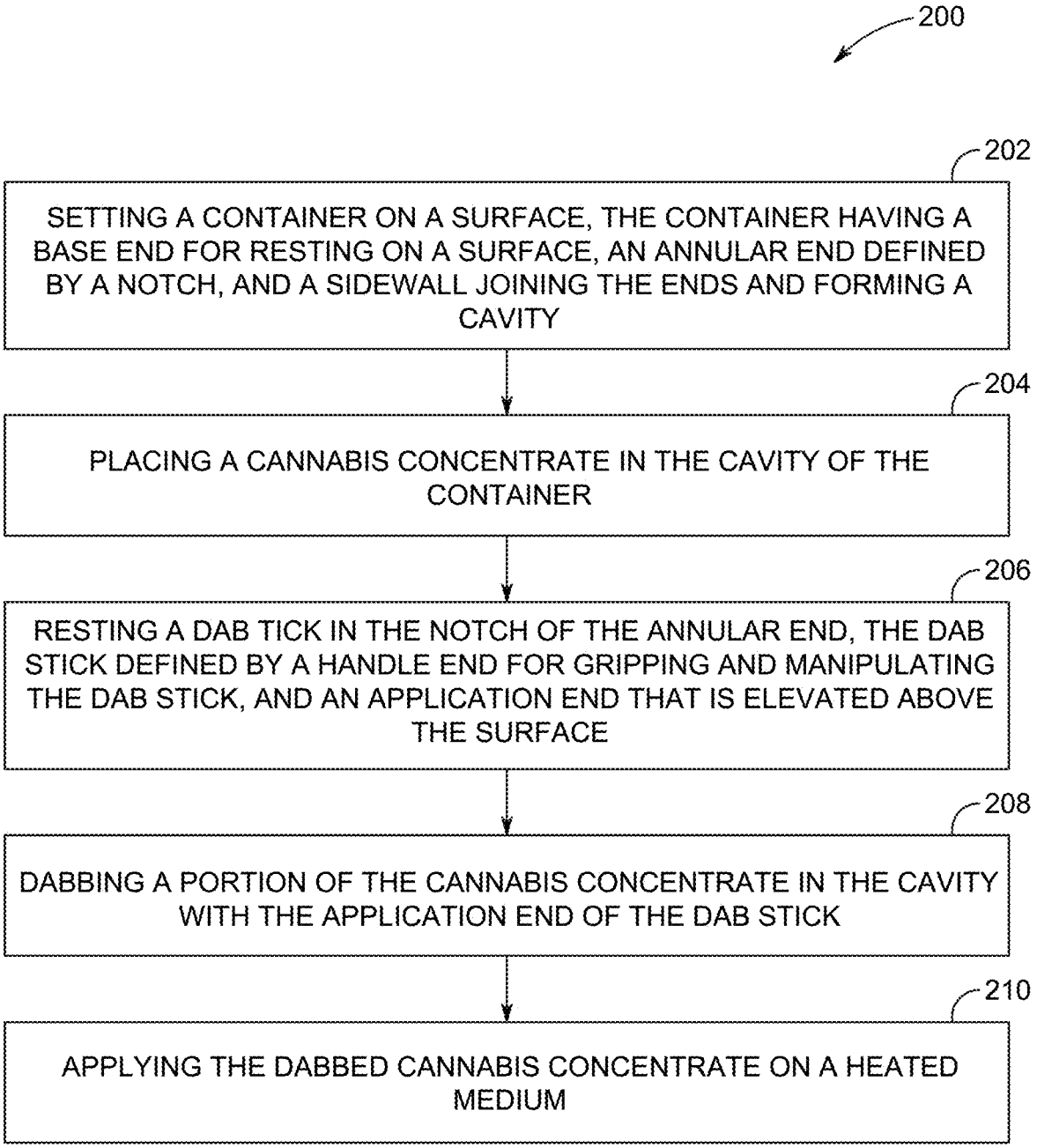
FIG. 8 illustrates a flowchart of an exemplary method for storing and applying a cannabis concentrate, in accordance with an embodiment of the present invention.

FIG. 8 illustrates a flowchart of an exemplary method 200 for applying a cannabis concentrate. The method 200 includes an initial Step 202 of setting a tool holding container on a surface, the tool holding container having a base end for resting on a surface, an annular end defined by a notch, and a sidewall joining the ends and forming a cavity. The method 200 may further comprise a Step 204 of placing a cannabis concentrate in the cavity of the tool holding container.

In some embodiments, a Step 206 may include resting a dab stick in the notch of the annular end, the dab stick is defined by a handle end for gripping and manipulating the dab stick, and an application end that is partially inserted in the notch of the annular end of the tool holding container, thereby allowing the application end of the dab stick to rest in an inclined elevated position above the annular end of the tool holding container when the dab stick is not in use. In some embodiments, a Step 208 comprises dabbing a portion of the cannabis concentrate in the cavity with the application end of the dab stick. A final Step 210 includes applying the dabbed cannabis concentrate on a heated medium.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A tool tray comprising:

at least one tool holding container, wherein the at least one container comprises a closed base end for resting on a surface, an annular open end defined by a notch, wherein a perimeter of the base end being larger than a perimeter of the annular end and a sidewall joining the base end with the annular end to form the tool holding container having an inner cavity to store concentrate, whereby the tool holding container is frustum shaped; and an elongated, thin, and cylindrical dab stick defined by a handle end and an application end, the application end defined by an application tip being broader than the dab stick, wherein the handle end allows for gripping and manipulating the dab stick and the application end allows for applying the concentrate to a heated medium, whereby the application end at least partially detachably inserts in the notch of the annular end of the tool holding container;

wherein the notch and the dab stick are relatively sized to and dimensioned to each other to facilitate holding concentrate in an elevated, stable position, thereby allowing the application end of the dab stick to rest in an inclined elevated position above the surface when the dab stick is not in use.

2. The tool tray of claim 1, wherein the notch of the annular end of the tool holding container has a U-shape.

3. The tool tray of claim 1, wherein the perimeter of the base end is double the perimeter of the annular end of the tool holding container, thereby increasing stability of the base while the container is resting on the surface.

4. The tool tray of claim 1, wherein the dab stick is fabricated from a material selected from the group consisting of titanium, quartz, and ceramic.

5. The tool tray of claim 1, wherein the heated medium is a nail for a water pipe.

6. The tool tray of claim 1, wherein the cavity of the tool holding container stores cannabis concentrate.

7. The tool holding container of claim 1 wherein the inner cavity comprises concentrate.

* * * * *